US005784949A

United States Patent [19]

Ryken et al.

[11] Patent Number: 5,784,949

[45] Date of Patent: Jul. 28, 1998

[54] RETAINING SYSTEM FOR SLIPPER HOLDDOWN PINS

[75] Inventors: Jim D. Ryken, Roland; Jeffrey A. Baldus, State Center; David D. Dirks; Scott D. Meyer, both of Ames, all of Iowa

[73] Assignee: Sauer Inc., Ames, Iowa

[21] Appl. No.: 882,135

[22] Filed: Jun. 25, 1997

[51] Int. Cl.[6] ..... F01B 13/04

[52] U.S. Cl. ..... 92/57; 92/71; 91/499; 417/269; 74/60

[58] Field of Search ..... 92/57, 71, 12.2; 91/499, 504, 505, 506; 417/269; 74/60

[56] References Cited

U.S. PATENT DOCUMENTS

| | | | |
|---|---|---|---|
| 2,776,628 | 1/1957 | Keel . | |
| 3,139,038 | 6/1964 | Stewart | 74/60 |
| 3,457,873 | 7/1969 | Fischer et al. . | |
| 3,468,263 | 9/1969 | Niemiec . | |
| 3,481,277 | 12/1969 | Pettibone . | |
| 3,643,549 | 2/1972 | Nagatomo | 91/505 |
| 3,693,508 | 9/1972 | Chondzinski | 91/499 |
| 3,698,287 | 10/1972 | Martin | 91/507 |
| 4,444,092 | 4/1984 | Schott | 91/506 |
| 5,251,537 | 10/1993 | Hoshino et al. | 91/506 |
| 5,279,205 | 1/1994 | Carlson, Jr. et al. | 91/499 |

*Primary Examiner*—Thomas E. Denion

*Attorney, Agent, or Firm*—Zarley, McKee, Thomte, Voorhees, & Sease

[57] ABSTRACT

An improved apparatus for retaining slipper holddown pins radially in a hydraulic unit includes a cylinder block having a plurality of holes therein for respectively receiving a corresponding plurality of elongated slipper holddown pins, each having a maximum transverse width. The holes are adjacent to and communicate with a center bore of the cylinder block to form respective throats. The throats have a maximum width that is less than the maximum transverse width of the pins such that the pins cannot be radially displaced through the respective throats. Each hole has a side wall that extends more than 180° around its central axis. The side wall defines the throat between the hole and the center bore. The shaft can be inserted into driving engagement with the center bore of the cylinder block. The slipper holddown pin has a maximum transverse width greater than the maximum width of the throat. Thus, the pin is radially constrained in the hole without applying external forces and cannot move radially outwardly through the throat. The bore of the cylinder block and the holes for receiving the pins can be simultaneously formed with a single broaching bar.

13 Claims, 4 Drawing Sheets

RETAINING SYSTEM FOR SLIPPER HOLDDOWN PINS

BACKGROUND OF THE INVENTION

The present invention relates to hydraulic power transmission devices, more particularly pumps and motors of the axial piston type. The invention relates to an improved means and method for retaining pins which holddown the slippers attached respectively to each of the reciprocating pistons.

In conventional axial piston hydraulic units whose inlet or charge pressure is relatively low, a slipper holddown mechanism is generally needed. One type of holddown mechanism utilized in open circuit pumps comprises a plurality of pins mounted in axially extending arcuate grooves spaced around the central bore of the cylinder block. The lower ends of the pins are engaged by a block spring which applies a holddown force that is transmitted to the slippers by the upper ends of the pins.

One shortcoming of the above mechanism is that each groove has a semi-circular cross-section which will only accommodate one-half the diameter of the pin. This allows the pins to be inserted laterally into the grooves, but a spring retainer comprising a C-shaped band of flat spring steel is needed to urge the pins radially outward so as to retain them in the slots. It would be desirable to eliminate the spring retainer and thereby reduce the number of components required in the pump. Another shortcoming of this spring retained pin mechanism is that it is difficult to assemble. The pins can become dislodged from the slots before the spring retainer is added. The pins may fall into the cylinder block or rotating group assembly where they are difficult to retrieve. Generally, the tops of three pins are used to define a plane for supporting the slippers. If one of the pins is lost, the remaining pins may not be able to provide the desired planar support.

Another conventional slipper holddown mechanism utilizes a footed pin. The generally L-shaped footed pin has an elongated vertical portion and a truncated horizontal portion which extends outwardly therefrom at an angle of approximately 90°. The horizontal portion of the footed pin engages the top of the block spring and extends radially outward beyond the inner diameter of the cylinder block. The vertical portion of the pin extends upwardly along a slot or groove provided in the inner diameter of the cylinder block. A plurality of pins and slots are spaced around the inner diameter of the cylinder block. The footed pin protrudes upwardly from the top of the cylinder block to support the slippers. However, each slot has an open side through which the footed pin can be inserted (and escape). The footed pins are easier to install than the spring retained pins because the spring retainer has been eliminated. However, the footed pins are much more costly to manufacture than straight pins.

Therefore, a primary object of the present invention is the provision of an improved means for retaining slipper holddown pins.

A further object of the present invention is the provision of a slipper holddown mechanism which prevents lateral or radial displacement of the pins once installed.

A further object of the present invention is the provision of a slipper holddown mechanism which is easy to assemble.

A further object of the present invention is the provision of a slipper holddown mechanism which provides a slot in the cylinder block with a side wall extending more than 180° so as to form a throat narrower than the pin.

A further object of the present invention is the provision of a slipper holddown system which is economical to produce, durable in use and simple in construction.

These and other objects will be apparent from the drawings, the description and the claims which follow.

SUMMARY OF THE INVENTION

The present invention relates to an improved apparatus for retaining slipper holddown pins, and thereby retaining slippers in an axial piston hydraulic unit. The hydraulic unit includes a cylinder block with a bore having a diameter which is drivingly engaged by a shaft. The cylinder block has a plurality of holes therein for respectively receiving a corresponding plurality of elongated slipper holddown pins which are in communication with the bore. Thus, throats are formed at the intersections of the holes and the bore. These throats have a maximum width that is less than the maximum transverse width of the pins. Therefore, the pins cannot be laterally or radially displaced through the throats. The pins are radially retained in the holes without applying external forces, as is conventionally done. Each hole has a central axis and a side wall that extends more than 180° around the central axis. The portion of the pin which extends through the throat into the inner bore of the cylinder block is juxtapositioned between the space and consecutive splines on the shaft.

Before or after inserting the shaft, the pins can be inserted into the holes in the cylinder block. Thus, the pins are radially constrained in the holes without applying external forces. The flexibility of the assembly process is enhanced. Not only does this apparatus make assembly of the rotating group much easier, a more reliable product results. The pins are not as likely to be dislodged and lost in the assembly process. Loose pins inside the hydraulic unit can cause poor performance or even premature failure of the unit.

An important manufacturing advantage is achieved with this invention. The profile of the bore of the cylinder block and the holes for receiving the pins can be simultaneously formed with a single broaching bar. The entire horizontal cross-sectional profile can be cut by pushing or pulling a single tool through the part. This is a significant advantage over the difficult and separate drilling operations which are conventionally required.

DETAILED DESCRIPTION OF THE PREFERRED EMBODIMENT

Figure 1:
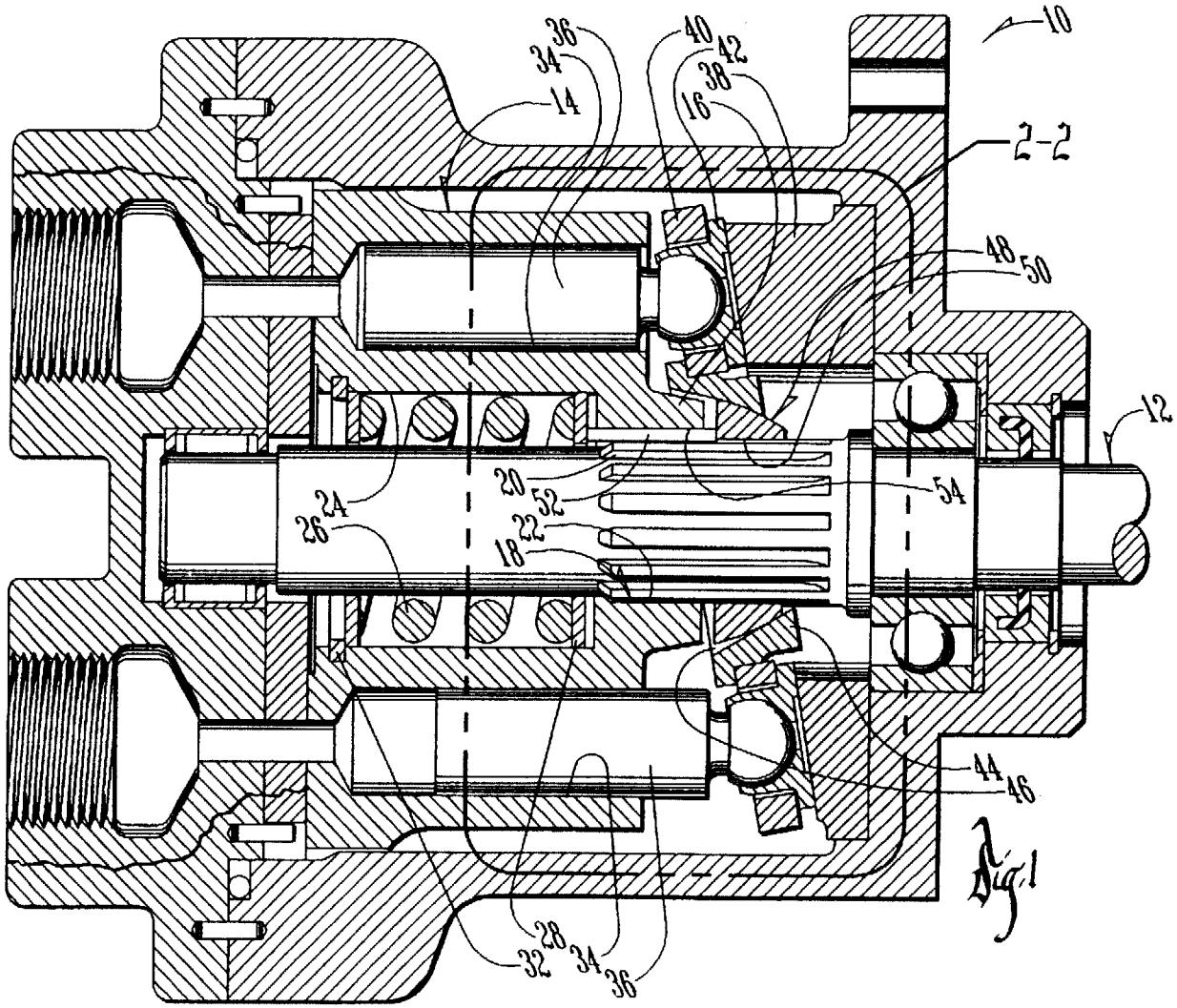
FIG. 1 is a cross-sectional view of a hydraulic unit having the slipper holddown mechanism of the present invention.

A hydraulic unit 10 is shown in FIG. 1. For purposes of illustration only, the hydraulic unit 10 is an axial piston open circuit pump. The invention can be adapted to other types of hydraulic units. The pump 10 includes an input shaft 12 which drivingly engages a cylinder block 14. The top of the cylinder block 14 includes a raised hub 16. A centrally located bore 18 (FIGS. 1, 2, 5) extends axially through the cylinder block 14 from top to bottom.

Figure 3:
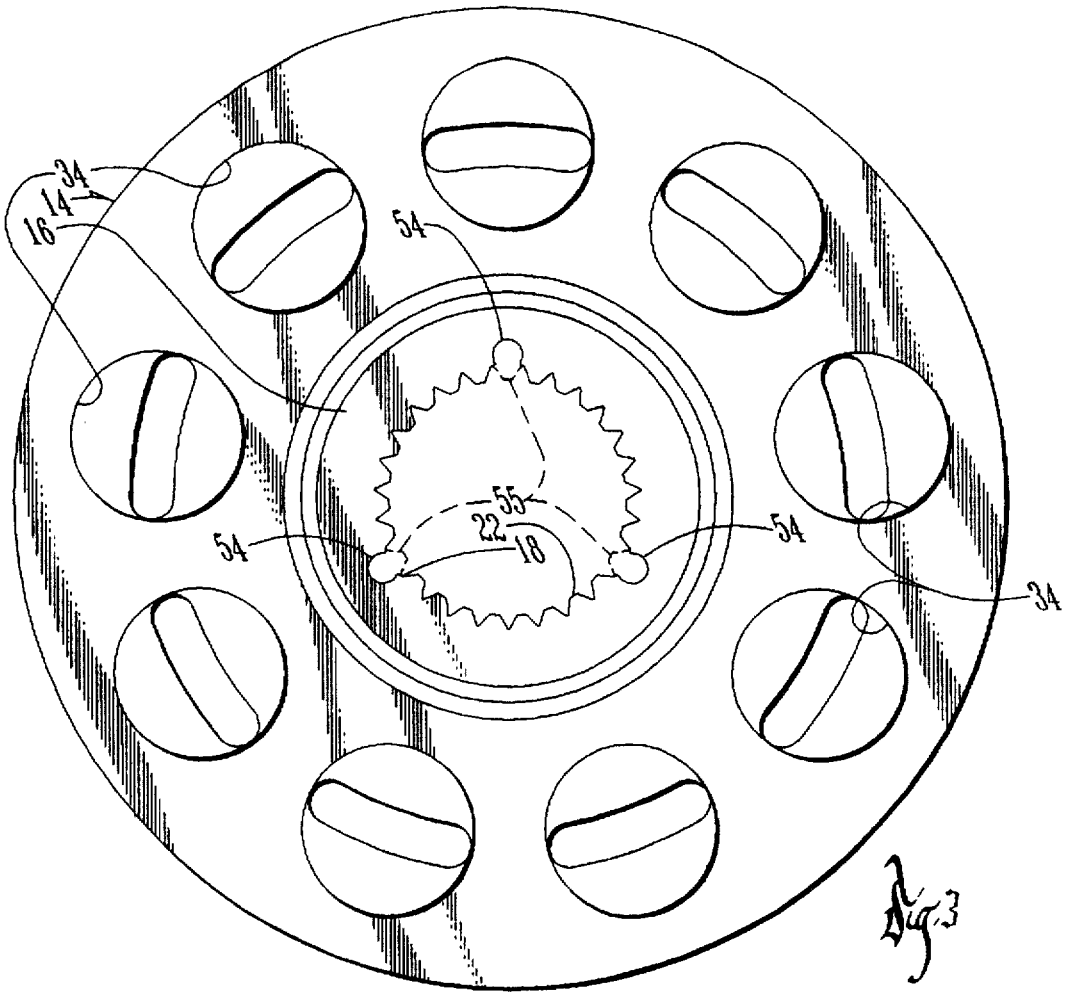
FIG. 3 is a view of the cylinder block, taken along line 3—3 in FIG. 2, showing the holes for receiving the slipper holddown pins.
Figure 4:
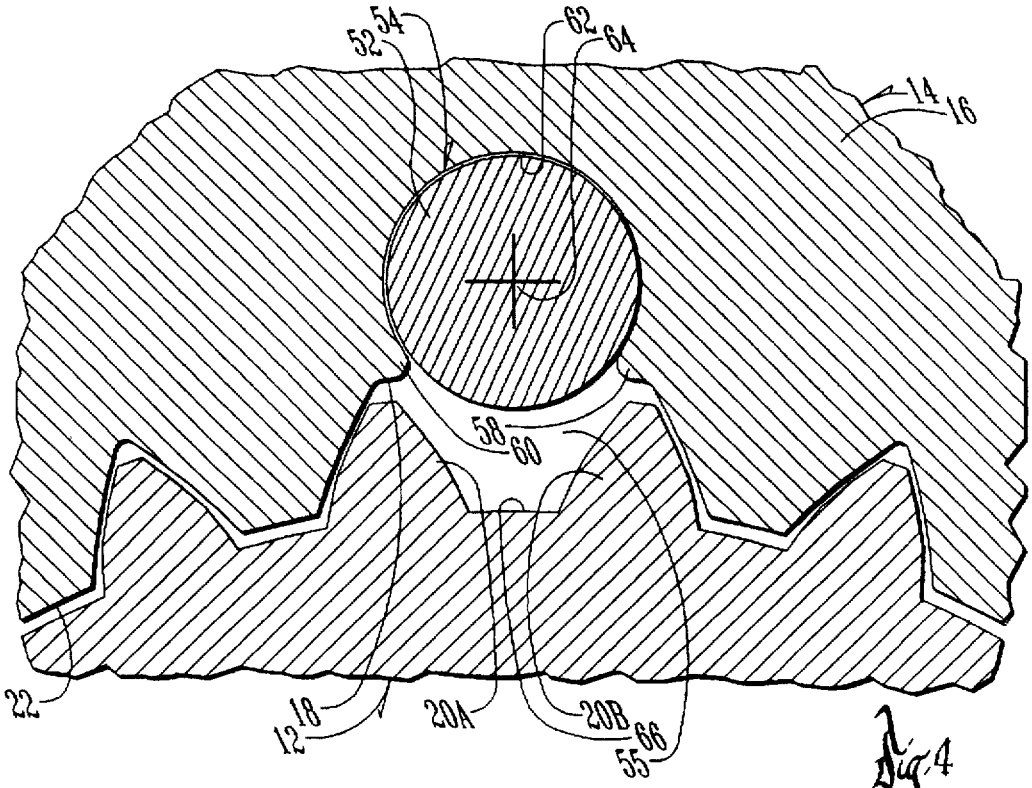
FIG. 4 is an enlarged scale sectional view taken on line 4—4 of FIG. 2.
Figure 5:
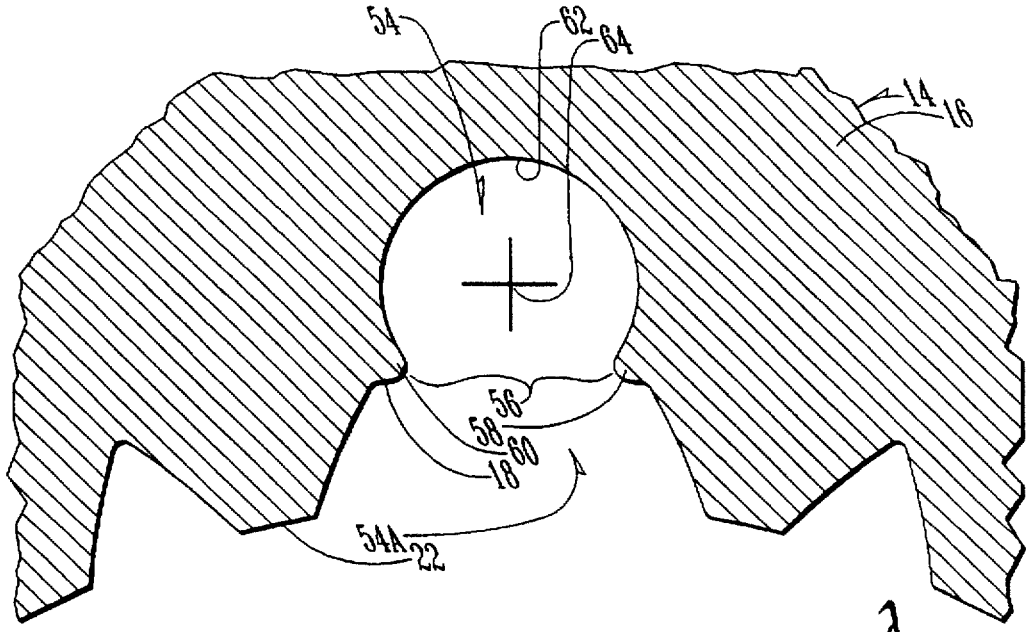
FIG. 5 is a sectional view similar to that of FIG. 4, but the shaft and pin of FIG. 5 have been removed.

A series of spaced apart involute splines 20 are provided on the shaft 12. The splines 20 matingly and drivingly engage a complementary series of spaced internal splines 22 formed on the diameter of the bore 18 of the cylinder block 14, as best seen in FIGS. 3–5. However, it is contemplated that other types of shaft/block engagement such as keys fitted to keyways, etc. can be utilized without detracting from the invention.

The lower end of the cylinder block 14 has a second centrally located bore 24 therein. The bore 24 receives a block spring 26 which abuts washers 28, 30 at either end and is held in place by a snap ring 32 conventionally mounted in the bore 24. The shaft 12 extends through the inner diameter of the spring 26.

As best seen in FIG. 3, the cylinder block 14 includes a plurality of bores 34 therein for slidably receiving a corresponding number of reciprocatable pistons 36. When the cylinder block 14 is rotated by the shaft 12, the pistons 36 reciprocate within the bores 34, thereby drawing in fluid, pressurizing it, and then displacing the pressurized fluid. The particular action of the individual pistons upon the fluid at any particular point during the rotation of the cylinder block 14 is determined by a fixed swashplate 38, as is well-known in the art.

Figure 2:
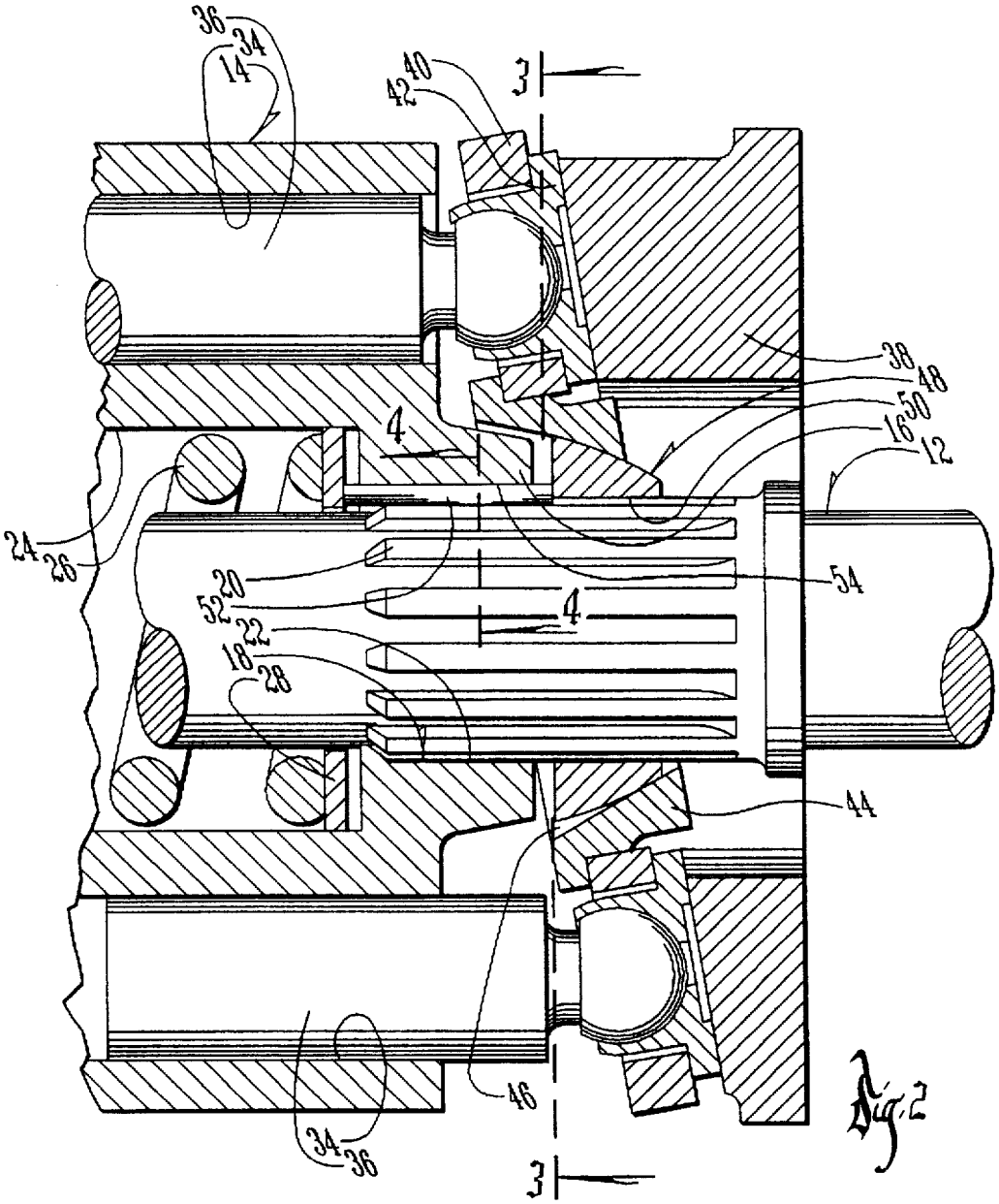
FIG. 2 is an enlarged cross-sectional view of the area designated by the line 2—2 in FIG. 1.

Each piston 36 has a slipper 40 attached thereto by conventional means such as swedging. A slipper retaining ring 42 engages the slipper 40 as shown in FIG. 2. The slipper retaining ring 42 is similarly engaged by a guide member 44. The guide member 44 has a centrally located conical opening 46 therein. The opening 46 pivotally engages the curved outer surface of a ball guide 48. The ball guide 48 has a central bore with a set of splines 50 which complement the splines 20 on the shaft 12. Thus, the ball guide 48 is rotated by the shaft 12. The guide member 44, the slipper retaining ring 42, and the slippers 40 are thus rotated substantially in unison with the cylinder block 14.

The ball guide 48 has a substantially flat planar lower surface which is supported by a plurality of slipper holddown pins 52. Preferably, three slipper holddown pins 52 are utilized so as to establish a level horizontal plane of support for the ball guide 48, as best seen in FIG. 2. It is contemplated that as few as two pins will suffice for slipper holddown purposes.

The novelty of the present invention lies primarily in the way the pins 52 are radially retained relative to the cylinder block 14. As shown in FIGS. 3–5, the cylinder block 14 includes a plurality of holes 54 adjacent to and in communication with an elongated groove 54A in the bore 18. When the device is assembled as shown in FIG. 4, the holes 54 are positioned adjacent a space 55 between the splines 22 on the bore 18 of the cylinder block 14. FIG. 5 illustrates that each of the holes 54 has a throat 56 whose width is defined by a pair of inwardly protruding shoulders 58, 60. The side wall 62 of the hole 54 extends more than 180° around the central axis 64 of the hole 54. If the hole is rectangular in cross-section, the side wall must extend more than 270° to retain the pin 52 laterally. In the round hole of the preferred embodiment, the side wall 62 extends between the shoulders 58, 60.

Each of the pins 52 extends axially in one of the corresponding holes 54, but cannot be radially or laterally displaced therefrom once installed. The lower end of the pin 52 engages the block spring 26 by abutting the washer 28. The upper ends of the pins 52 protrude from the cylinder block at the hub 16 and engage the lower planar surface of the ball guide 48, as best seen in FIG. 2. Through the spring 26, the pins 52 and the ball guide 48, a holddown force is applied to the slippers 40.

In FIG. 4, the pin 52 it is seen that the pin 52 has a maximum transverse diameter or width that allows it to be slip fit longitudinally into the hole 54. Furthermore, the maximum transverse diameter of the pin 52 is greater than the maximum width or span across the throat 56 of the hole 54. Conversely, throat 56 of the hole 54 must be less than the diameter of the pin 52. Thus, the side wall 62 must extend more than 180° around the central axis 64 when the hole 54 is round. The diameter of the pin 52 and the presence of the shoulders 58, 60 prevent the pin 52 from being radially displaced from the hole 54.

As can be seen from FIG. 3, three holes 54 and pins 52 are preferably utilized. The upper ends of the three pins securely establish a plane of support for the ball guide 48 and thereby for the slippers 40. It is contemplated that additional pins could be utilized.

One important advantage of this structure is that the internal splines 22 on the inner diameter of bore 18 of the cylinder block 14 can be formed simultaneously with the holes 54 by pushing or pulling a single broaching bar through the cylinder block 14.

In operation, the pins 52 can be inserted into hole 54 either before or after the insertion of shaft 12 into bore 18. In neither event will the pins fall radially inwardly through throat 56. A pin 52 is radially constrained in the hole 54 by the side wall 62. Any portion of the pin 52 extending radially inward through throat 56 into bore 18 of the cylinder block 14 is received in the space 55 between the splines 20A, 20B of the shaft.

Thus, it can be seen that the present invention at least achieves its stated objects.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An improved apparatus for retaining slipper holddown pins radially in a hydraulic unit having a cylinder block including a center bore drivingly engaged by a shaft, the improvement being characterized by:

the cylinder block having a plurality of elongated holes therein extending parallel to said center bore, said holes being in communication with said center bore through an elongated throat opening extending along the length of the holes, an elongated slipper holddown pin in each of said holes with end pins having a width greater than the transverse width of said throat opening so the pins cannot be radially displaced through the respective throat openings.

2. The apparatus of claim 1, further characterized by the holes being round and the side wall extending more than 180 degrees around a central axis of each of the holes.

3. The apparatus of claim 1, further characterized by each of the throat openings having longitudinal shoulders along opposite side edges thereof to resist radial displacement of the pins through the throat openings.

4. The apparatus of claim 1, further characterized by at least three of the holes and corresponding number of pins being included.

5. The apparatus of claim 1, further characterized by the holes being equally spaced around a periphery of the center bore.

6. The apparatus of claim 1, further characterized by the center bore of the cylinder block having a central axis, and the holes having respective centers located at a constant radial distance from the central axis.

7. The apparatus of claim 1, further characterized by the center bore of the cylinder block having a plurality of protruding spaced spline teeth, an extended circumferential space existing between spline teeth adjacent the holes and throat openings.

8. The apparatus of claim 7, further characterized by the shaft having a plurality of circumferentially spaced raised spline teeth thereon with at least two of said spline teeth dwelling within said extended space when the shaft engages the center bore of the cylinder block.

9. The apparatus of claim 1, further characterized by the cylinder block having a block spring bore therein axially adjacent the center bore, the holes in the cylinder block extending into the block spring bore.

10. The apparatus of claim 1 wherein the pins are longitudinally slidably mounted in holes.

11. The apparatus of claim 1 wherein the pins are substantially straight.

12. The apparatus of claim 1 wherein the pins are cylindrical.

13. An improved apparatus for retaining slipper holddown pins radially in a hydraulic unit having a cylinder block including a center bore, the improvement being characterized by:

the cylinder block having a plurality of elongated holes therein extending parallel to said center bore, said holes being in communication with said center bore through an elongated throat opening extending along the length of the holes, an elongated slipper holddown pin in each of said holes with each pin having a width greater than the transverse width of said throat openings so the pins cannot be radially displaced through the respective throat openings.

* * * * *